United States Patent [19]

Aeba

[11] 4,281,788

[45] Aug. 4, 1981

[54] FOLDING PACKAGE

[76] Inventor: Takako Aeba, No. 401 Shuwa Naito-machi Residence, 1-26, Naito-machi, Shinjuku-ku, Tokyo 160, Japan

[21] Appl. No.: 176,541

[22] Filed: Aug. 7, 1980

[51] Int. Cl.[3] ..... B65D 5/10

[52] U.S. Cl. ..... 229/22

[58] Field of Search ..... 229/22

[56] References Cited

U.S. PATENT DOCUMENTS

| | | | |
|---|---|---|---|
| 1,431,730 | 10/1922 | Gearson | 229/22 |
| 1,664,111 | 3/1928 | Johnson | 229/22 X |
| 2,349,589 | 5/1944 | Harrington | 229/22 |
| 3,482,760 | 12/1969 | Pascus et al. | 229/22 |
| 3,550,834 | 12/1970 | McCall | 229/22 |
| 4,121,752 | 10/1978 | Ravatto | 229/22 X |
| 4,202,485 | 5/1980 | Fremion | 229/22 |

*Primary Examiner*—Davis T. Moorhead

[57] ABSTRACT

A sheet of paper has several sections defined by creases thereon. They include three rectangular sections arranged side-by-side, two triangular sections, and four blocking sections. When the sheet of paper is folded along the creases, it is formed into the shape of a hollow triangular prism. Thus, the folded paper presents a package in which matches or any other things can be suitably contained. A stopper is also provided so that it can hold the triangular prism shape.

3 Claims, 4 Drawing Figures

FOLDING PACKAGE

BACKGROUND OF THE INVENTION

The present invention relates to a folding package which can be folded into the shape of a hollow triangular prism out of a sheet of paper to contain things therein and which can be unfolded for easy storing. The present invention is particularly useful when used as a match container, though use should not be limited only for that purpose.

Match boxes and folders, or sometimes called as match books, are the conventional containers for matches. It is true that matches are less used at home these days, but they are still used in volume especially at restaurants and hotels. Matches are mainly used as free-to-take souvenirs at these places since match boxes and folders play an important role in advertisement. Moreover, it is also true that matches are still important in our daily life and even at home.

Match boxes are usually used for storing wood strip matches. Wood strip matches are more convenient for lighting by friction as compared with cardboard strip matches which are usually folded in a small match book. It is often required or desirous from various reasons to keep matches separately from the container, such as match boxes and folders. For example, since the containers are usually provided with a friction surface, they must be kept separately to eliminate fire hazard. When a large volume of matches are kept at a storage, it is often required to keep the matches in a fire-proof container. Under such circumstances, the conventional match containers are disadvantageous because empty match boxes will require a large storing space, and a match folder and an array of cardboard matches must be stapled or glued together.

Oftentimes, one finds many unused matches at home. There are many occasions to collect free-to-take matches, and these collected matches are just kept in drawers or on shelves without being used for an extended period of time. Some are in match boxes and others are in small folders. In such a case, it is desirous to keep matches in a sealed container, such as a jar, in order to keep them dry. Moreover, in order to eliminate fire hazard, it is desirous to keep matches separately from a box which has a friction surface for lighting. Again, empty boxes are troublesome because they will occupy a large space.

SUMMARY OF THE INVENTION

It is a primary object of the present invention to provide a folding package which can be easily folded for use as a container and which can be easily unfolded to a sheet of paper for storing.

Another object of the present invention is to provide a folding package which is particularly useful as a match container.

A further object of the present invention is to provide a folding package which can be easily manufactured at low cost.

Other objects, features, and advantages of the present invention will become apparent after a reading of the remainder of this specification and the attached drawings. For a fuller understanding of the nature and advantages of the invention, reference should be had to the ensuing detailed description taken in conjunction with the accompanying drawings.

BRIEF DESCIPTION OF THE DRAWINGS

DESCRIPTION OF THE PREFERRED EMBODIMENTS

Figure 1:
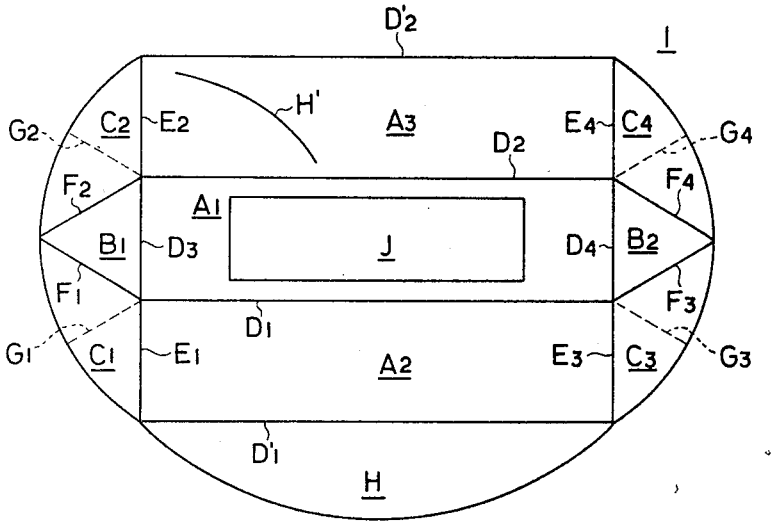
FIG. 1 is a top plan view showing the unfolded state of one embodiment of the present folding package.
Figure 2:
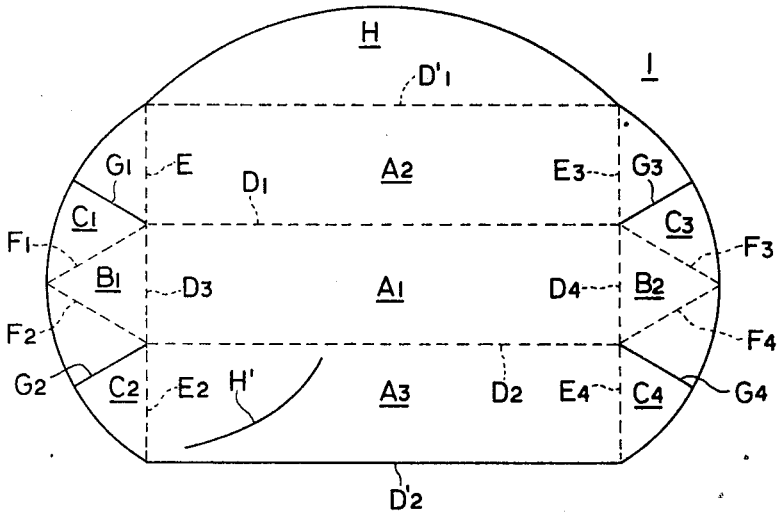
FIG. 2 is a bottom plan view of the embodiment shown in FIG. 1.

Referring to FIGS. 1 and 2, the folding package 1 consists of a sheet of paper in a desired peripheral shape. The package 1 containes various sections which are defined by creases formed on the sheet of paper. The creases are shown with solid and dotted lines in FIGS. 1 and 2. The solid lines and dotted lines indicate that they are bent in the opposite directions.

The package 1 includes three rectangular sections $A_1$, $A_2$, and $A_3$, which are arranged side by side. The section $A_3$ and the section $A_1$ have a common side line $D_2$, and the side line $D_1$ is shared by the sections $A_1$ and $A_2$. The side lines $D_1$ and $D_2$ are creased so that the sections $A_1$, $A_2$ and $A_3$ present three side surfaces when they are bent to form a hollow triangular prism. A stopper section H is provided along the side line $D'_1$ of the section $A_2$. While, the section $A_3$ is provided with a slit H' into which the stopper H may be partly inserted with the three rectangular sections $A_1$, $A_2$ and $A_3$ are bent to form a triangular prism. On the surface of the section $A_1$ is provided a friction surface J against which a match can be struck for lighting.

Two triangular sections $B_1$ and $B_2$ are provided along the end lines $D_3$ and $D_4$, respectively, of the rectangular section $A_1$. Two sides, $F_1$ and $F_2$ or $F_3$ and $F_4$, of each of the triangular sections $B_1$ and $B_2$ must be equal in length to the corresponding end lines $E_1$ and $E_2$ or $E_3$ and $E_4$, respectively. The package 1 also has four fan-shaped web sections $C_1$ through $C_4$. Each of the web sections has a folding line, $G_1$ through $G_4$, along which the web section can be folded inside the package.

Figure 3:
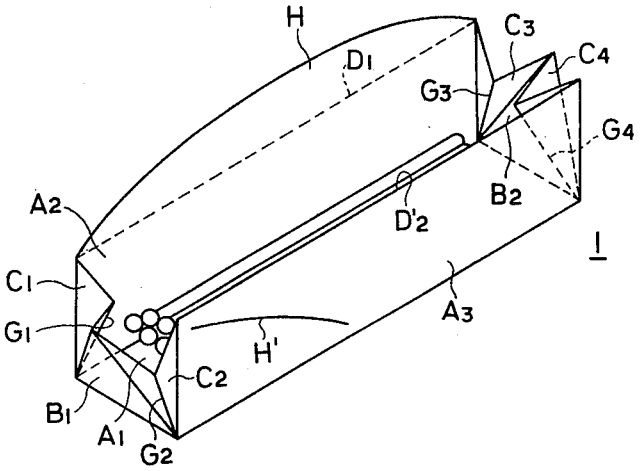
FIG. 3 is a perspective view showing the half-folded state of the present embodiment.

In the embodiment shown in FIGS. 1 and 2, the web section is provided to bridge between the triangular section and the rectangular section. It is to be noted, however, that the web section can also be provided in different manners. For example, focussing on the web section C, for the purpose of explanation, the web section C, can be partly cut away along the lines $G_1$ and $E_1$, or along the lines $G_1$ and $F_1$. In any event, the web sections, whether partly cut away or not, will have the function of blocking the things contained in the package, thus preventing them from falling off when the package is half open, as seen in FIG. 3.

Figure 4:
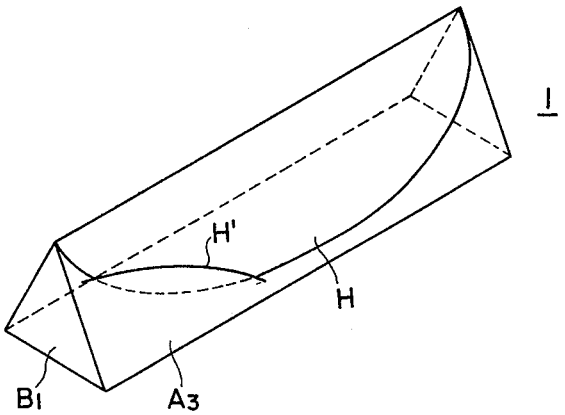
FIG. 4 is a perspective view showing the completely folded state.

In use, since the package 1 has predetermined crease lines, it can be folded quite easily. And, when it is half folded, as shown in FIG. 3, matches or any other things can be placed in the cavity defined by the half folded package. Then, the package 1 can be folded completely and the stopper H can be inserted in the slit H' to hold the intended shape as shown in FIG. 4. A stopper and slit combination is most preferable, but any other fastening means or hook means can also be employed. If it is desired to keep matches or any other things contained in the folded package to some other place, e.g., in a jar or sealed box, then the package 1 can be completely unfolded as shown in FIG. 1 and 2. The unfolded package is nothing but a sheet of paper so that it is most convenient and space saving for storing.

Obviously, numerous variations and modifications can be made without departing from the present invention. Accordingly, it should be clearly understood that the form of the present invention described above and shown in the accompanying drawings is illustrative only and is not intended to limit the scope of the present invention.

What is claimed is:

1. A folding package comprising a sheet of paper having several sections defined by creases formed thereon, said sections including three rectangular sections arranged side by side, two triangular sections, each of which has a side common to the end line of the central rectangular section, and four web sections, each of which bridges between one of said triangular section and one of said rectangular sections; and holding means for holding an intended shape when folded.

2. The package of claim 1 wherein said web sections are partly cut away.

3. The package of claim 1 wherein said holding means comprises a stopper section formed as a part of said sheet of paper and a slit formed in said sheet of paper whereby said stopper section may be inserted in said slit to hold the intended shape when folded.

* * * * *